US007403173B2

(12) United States Patent
Shimamori et al.

(10) Patent No.: US 7,403,173 B2
(45) Date of Patent: Jul. 22, 2008

(54) ANTENNA DEVICE

(75) Inventors: Takao Shimamori, Kanagawa-ken (JP); Minoru Hasegawa, Kanagawa-ken (JP)

(73) Assignee: Samsung Electronics Co., Ltd. (KR)

( * ) Notice: Subject to any disclaimer, the term of this patent is extended or adjusted under 35 U.S.C. 154(b) by 19 days.

(21) Appl. No.: 11/644,787

(22) Filed: Dec. 22, 2006

(65) Prior Publication Data

US 2007/0182648 A1 Aug. 9, 2007

(30) Foreign Application Priority Data

Dec. 22, 2005 (JP) ..... 2005-370029
Aug. 21, 2006 (KR) ..... 10-2006-0078761

(51) Int. Cl.
*H01Q 3/24* (2006.01)

(52) U.S. Cl. ..... 343/876; 343/702; 343/895

(58) Field of Classification Search ..... 343/876, 343/895, 702, 850, 860
See application file for complete search history.

(56) References Cited

U.S. PATENT DOCUMENTS 6,181,286 B1 * 1/2001 Roscoe et al. ..... 343/725
6,624,795 B2 * 9/2003 Boyle ..... 343/895
7,053,839 B2 * 5/2006 Cassel et al. ..... 343/702
7,158,819 B1 * 1/2007 Pulimi et al. ..... 455/575.5

FOREIGN PATENT DOCUMENTS

EP 1 176 663 1/2002

* cited by examiner

*Primary Examiner*—Hoang V Nguyen
(74) *Attorney, Agent, or Firm*—McNeely Bodendorf LLP

(57) ABSTRACT

Provided is a compact antenna for installment in a portable terminal and adjusting a resonant frequency. The compact antenna device includes an antenna unit including first and second elements, the first element including a first antenna terminal having at least one of meandering and curved patterns wholly or partially, and the second element including an end connected to another end of the first element and another end having a second antenna terminal, a feeding unit exciting the antenna unit through the first and second antenna terminals, a switching circuit connected between the antenna unit and the feeding unit and selectively switching one or both of the first and second elements in order to connect one or both of the first and second elements to the feeding unit. A resonant frequency of the antenna unit varies during feeding by the feeding unit depending on the switching operation of the switching circuit.

15 Claims, 18 Drawing Sheets

ANTENNA DEVICE

PRIORITY

This application claims the benefit of Japanese Patent Application No. 2005-370029, filed in the Japanese Intellectual Property Office on Dec. 22, 2005, and Korean Patent Application No. 10-2006-0078761, filed in the Korean Intellectual Property Office on Aug. 21, 2006, the contents of which are incorporated herein by reference.

BACKGROUND OF THE INVENTION

1. Field of the Invention

The present invention relates generally to an antenna device, and more particularly, to a compact antenna device suitable for installment in a portable terminal and tunable to a resonant frequency.

2. Description of the Related Art

Portable devices such as notebooks and portable terminals require compact antennas in order to receive television (TV) signals and other signals. In this case, antennas having meandering or helical shapes may be considered as compact high performance antennas. However, since conventional helical antennas or monopole antennas are compact, they provide narrow bands and are difficult to match with portable terminals.

European Patent No. EP1,176,663A1 discloses a helical antenna technique used in a portable terminal. In the disclosure, a terminal is installed in an intermediate or front part of an element of a helical antenna. A filter including strip lines having different lengths, an inductor, and a capacitor are connected to the terminal using a switch.

However, a helical antenna circuit is complicated, and it is difficult to minutely tune to a resonant frequency. Accordingly, there exists a need for further development of the circuitry.

SUMMARY OF THE INVENTION

The present invention provides a compact antenna device suitable for installment in a portable terminal and tunable to a resonant frequency.

According to the present invention, there is provided an antenna unit including first and second elements, the first element including a first antenna terminal having at least one of meandering and curved patterns wholly or partially, and the second element including a first end connected to a first end of the first element and a second end having a second antenna terminal, a feeding unit exciting the antenna unit through the first and second antenna terminals, a switching circuit connected between the antenna unit and the feeding unit and selectively switching one or both of the first and second elements in order to connect one or both of the first and second elements to the feeding unit, wherein a resonant frequency of the antenna unit varies during feeding by the feeding unit depending on the switching operation of the switching circuit.

The antenna device further includes a matching adjusting circuit connected to the switching circuit and adjusting the resonant frequency of the antenna part, wherein the switching circuit connects one of the first and second elements to the feeding unit and the other one of the first and second elements, which is not connected to the feeding unit, to the matching adjusting circuit.

According to the present invention, there is provided an antenna unit including first and second elements, the first element including a first antenna terminal having at least one of meandering and curved patterns wholly or partially, and the second element including a first end connected to a first end of the first element and a second end having a second antenna terminal, a matching adjusting circuit connected to one of the first and second antenna terminals and adjusting a resonant frequency of the antenna unit, and a feeding unit exciting the antenna part through the other one of the first and second antenna terminals which is not connected to the matching adjusting circuit.

BRIEF DESCRIPTION OF THE DRAWINGS

The above and other features and advantages of the present invention will become more apparent by describing in detail preferred embodiments thereof with reference to the attached drawings in which:

FIG. 8A illustrates a switching circuit when a helical element is turned on;

FIG. 8C illustrates the switching circuit when two elements are turned on;

DETAILED DESCRIPTION OF THE INVENTION

Hereinafter, embodiments of the present invention will be described in detail with reference to the attached drawings. A detailed description of known functions will be omitted for the sake of clarity and conciseness.

Figure 1:
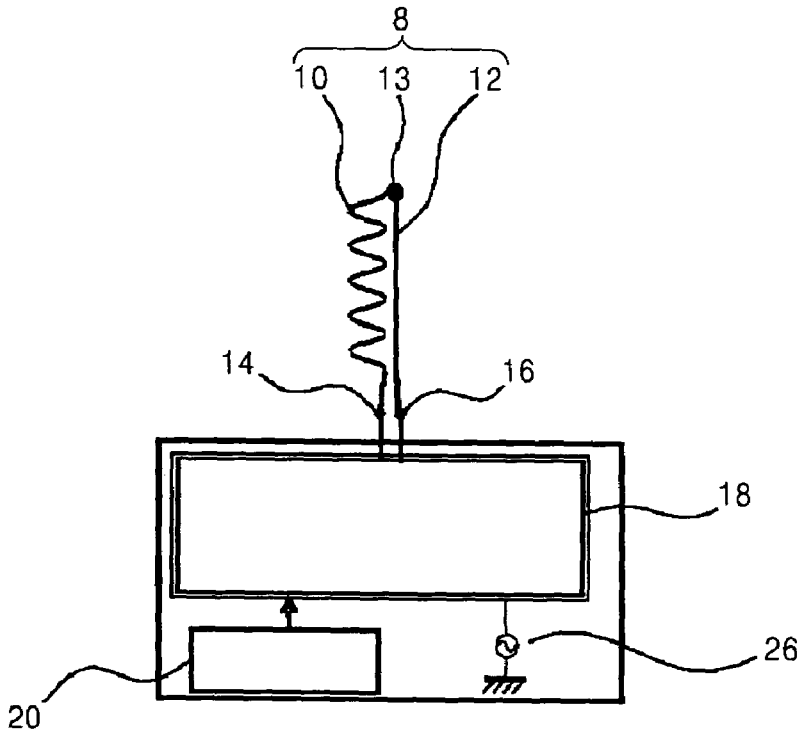
FIG. 1 illustrates an antenna device according to the present invention.

FIG. 1 illustrates an antenna device according to the present invention. Referring to FIG. 1, the antenna device includes an antenna unit 8 including first and second elements 10 and 12 and a feeding unit 26 exciting the antenna unit 8.

A first end of the first element 10 is electrically connected to a top end 13 of the second element 12 at a top part 13. The second element 12 may be shorter than the first element 10. A portion of or the entire first element 10 may have at least one of meandering and curved patterns. For example, the first element 10 may be formed in a helical structure. Also, the second element 12 may be formed in a linear structure.

The first element 10 includes a first antenna terminal at a second end thereof, and the second element 12 includes a second antenna terminal at a bottom end thereof. The first and second antenna terminals are respectively connected to first and second input and output terminals 14 and 16 of a RFAN 18, which includes three or more high frequency signal input and output terminals and one or more control signal input and output terminals. The feeding unit 26 excites the antenna unit 8, and a control circuit 20 controls the RFAN 18.

Figure 2:
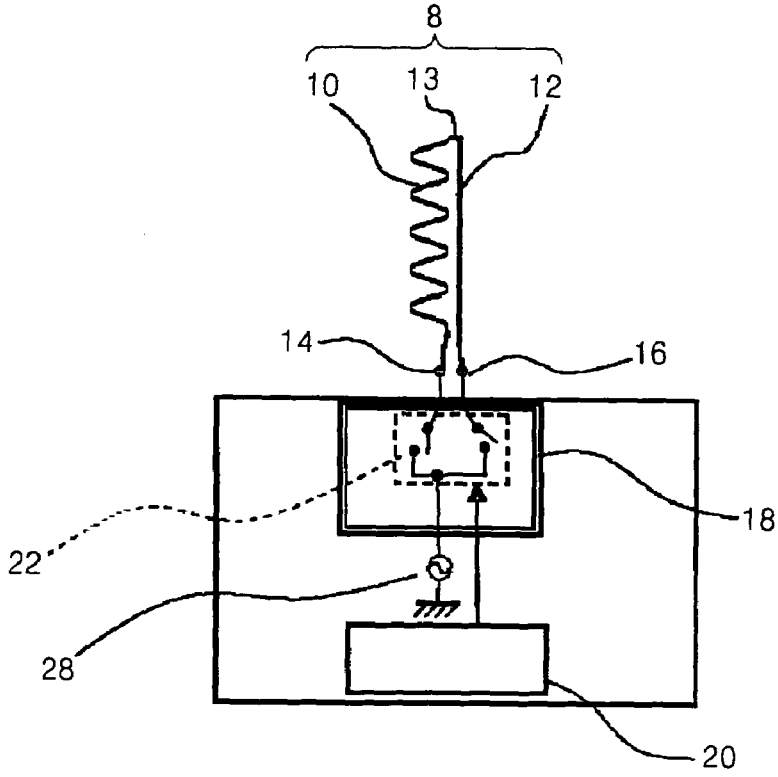
FIG. 2 illustrates a Resonant Frequency Adjustable Network (RFAN) of the antenna device illustrated in FIG. 1.

FIG. 2 illustrates a first RFAN 18 according to the present invention. Referring to FIG. 2, the RFAN 18 includes a switching circuit 22 that switches on the first and second input and output terminals 14 and 16 in order to connect the first and second input and output terminals 14 and 16 to the feeding unit 26. The switching circuit 22 will be described later in more detail.

Figure 3A:
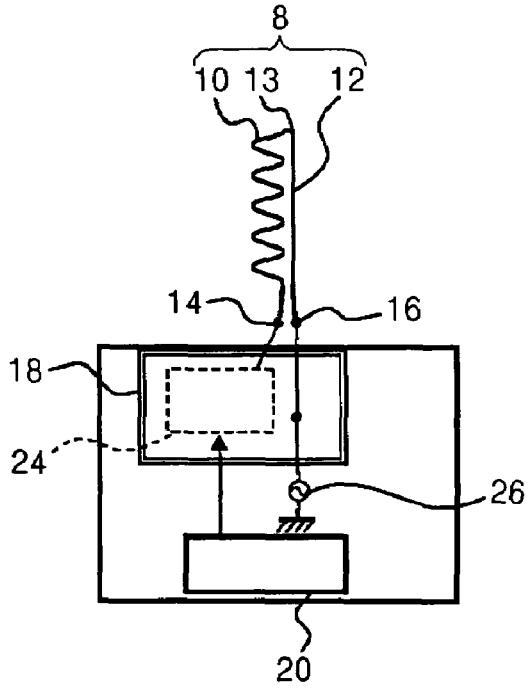
FIGS. 3A and 3B illustrate the RFAN of the antenna device illustrated in FIG. 1.
Figure 3B:
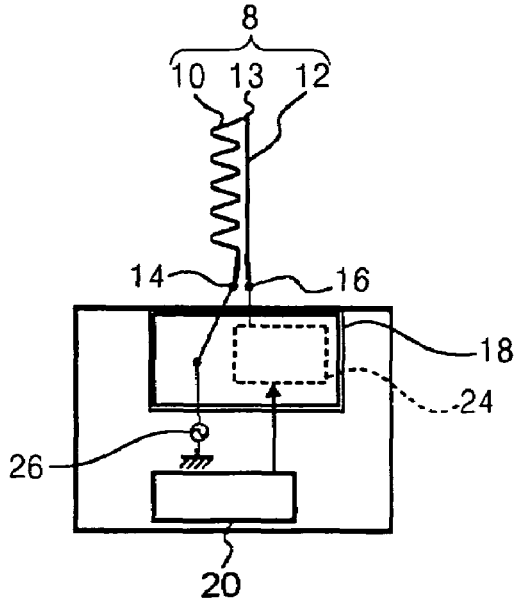

FIGS. 3A and 3B illustrate second and third RFANs 18 according to embodiments of the present invention. Referring to FIGS. 3A and 3B, the RFAN 18 includes a matching adjusting circuit 24. As shown in FIG. 3A, the matching adjusting circuit 24 controlled by the control circuit 20 is connected to the first input and output terminal 14, and the feeding unit 26 is connected to the second input and output terminal 16. Alternatively, as shown in FIG. 3B, the matching adjusting circuit 24 controlled by the control circuit 20 is connected to the second input and output terminal 16, and the feeding unit 26 is connected to the first input and output terminal 14.

Figure 4:
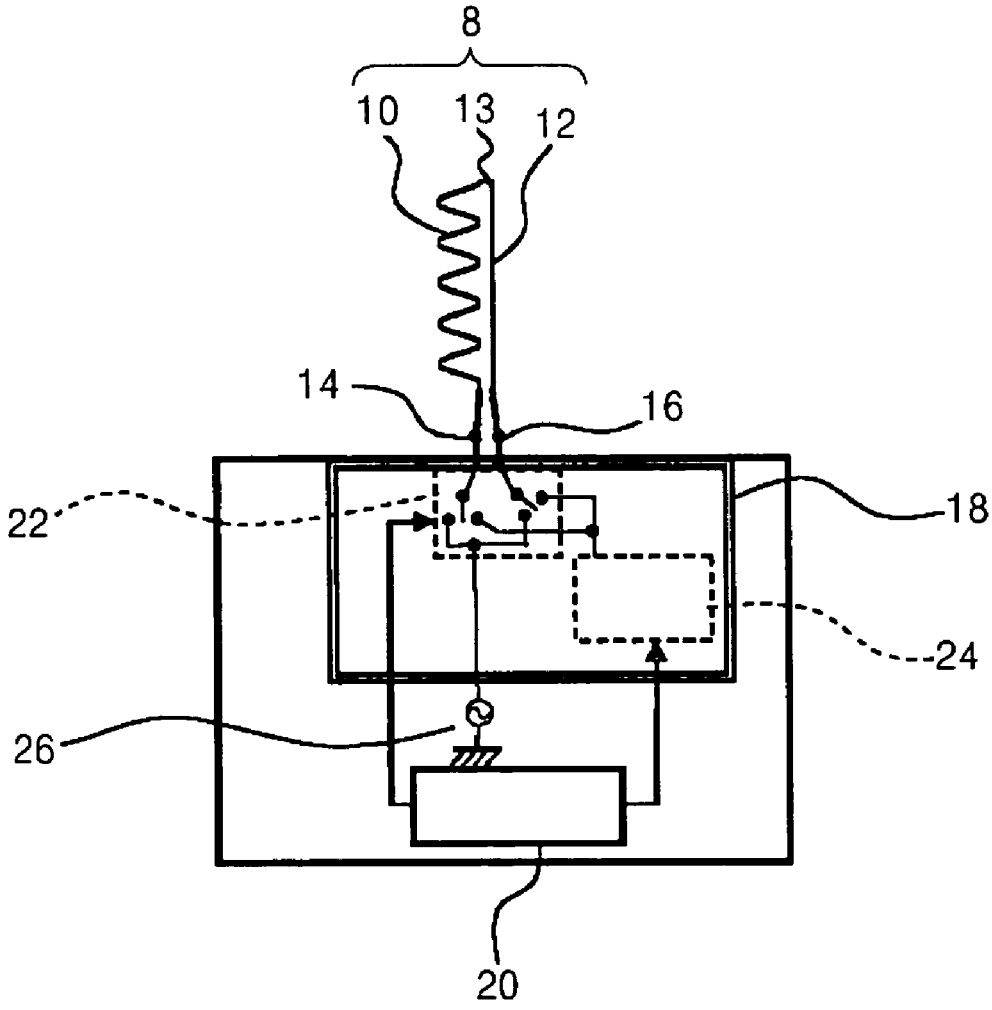
FIG. 4 illustrates the RFAN of the antenna device illustrated in FIG. 1.

FIG. 4 illustrates a fourth RFAN 18 according to the present invention. The RFAN 18 includes the matching adjusting circuit 24 and the switching circuit 22. The control circuit 20 controls the matching adjusting circuit 24 and the switching circuit 22.

Figure 5A:
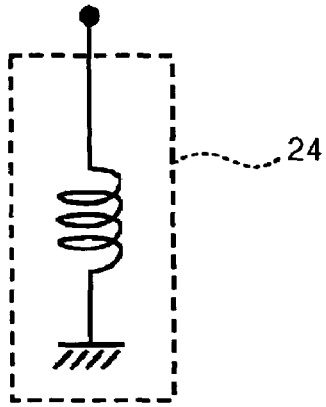
FIGS. 5A through 5C illustrate a matching adjusting circuit according to the present invention.
Figure 5B:
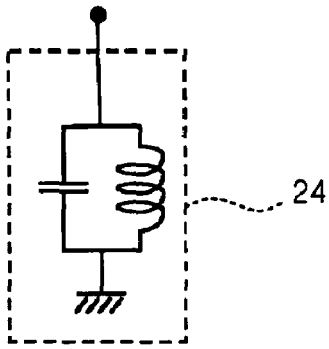
Figure 5C:
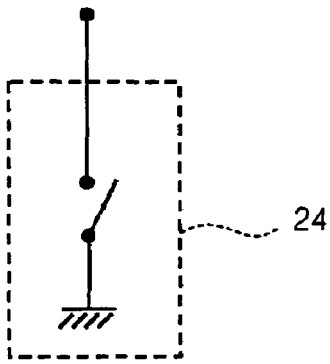
Figure 6:
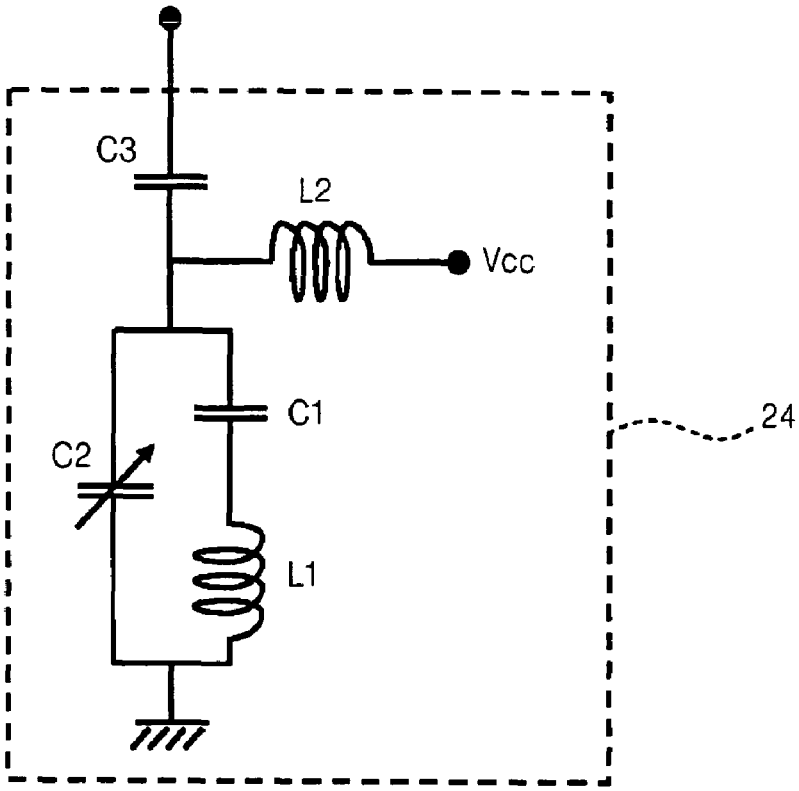
FIG. 6 illustrates a matching adjusting circuit according to the present invention.
Figure 7:
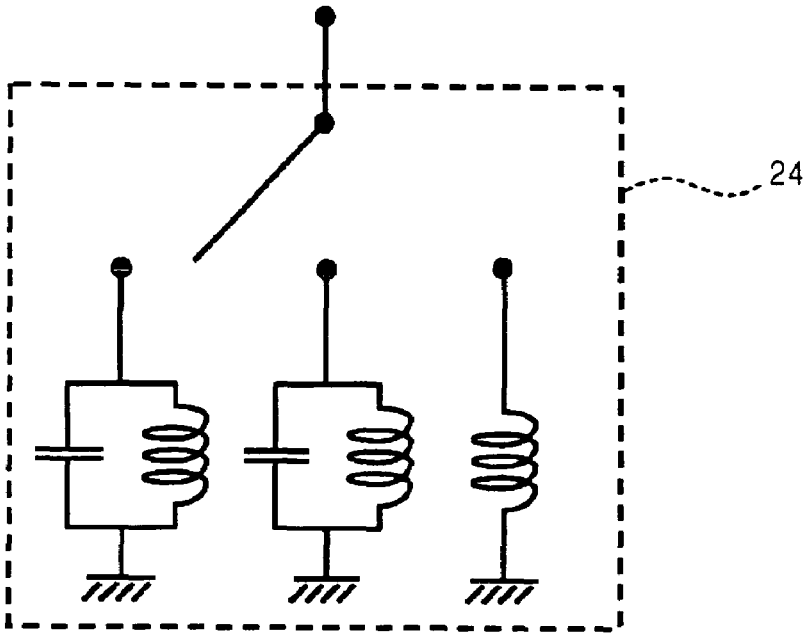
FIG. 7 illustrates a matching adjusting circuit according to the present invention.

FIGS. 5A through 5C, 6, and 7 illustrate first through fifth matching adjusting circuits 24 according to the present invention. The first matching adjusting circuit 24 may be realized as an inductor as shown in FIG. 5A. The second matching adjusting circuit 24 may be realized as a parallel circuit including an inductor and a capacitor as shown in FIG. 5B. The third adjusting circuit 24 may be realized as a switch as shown in FIG. 5C. Referring to the fourth adjusting circuit 24 is FIG. 6, an inductor L1 is connected in series with a capacitor C1, a variable capacitor C2 is connected in parallel with a circuit including the inductor L1 and the capacitor C1, and a capacitor C3 is connected to a circuit including the inductor L1, the capacitor C1, and the variable capacitor C2 and to a power supply voltage VCC through an inductor L2 so as to control the capacitor C2. The matching adjusting circuit 24 may be appropriately selected from the above examples to reduce a Voltage Standing Wave Ratio (VSWR) of the antenna unit 8 so as to transmit a signal at a high sensitivity. As shown in FIG. 7, the fifth matching adjusting circuit 24 may include a plurality of circuits as illustrated in FIGS. 5A through 5C and in FIG. 6. A switch may select one of the plurality of circuits tuned to a resonant frequency. The matching adjusting circuit 24 is not limited to these examples.

Figure 8A:
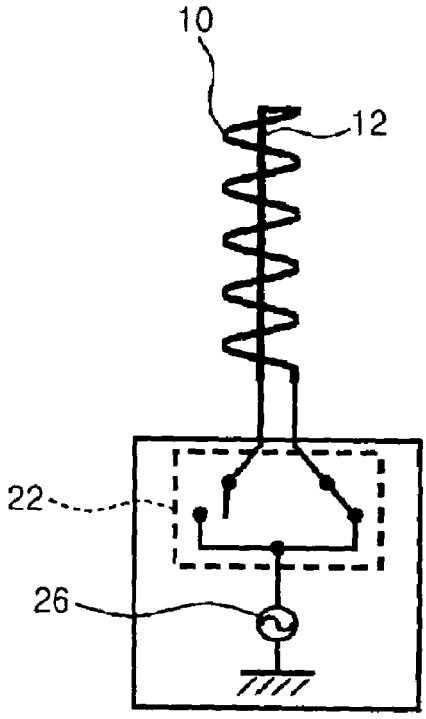
Figure 8B:
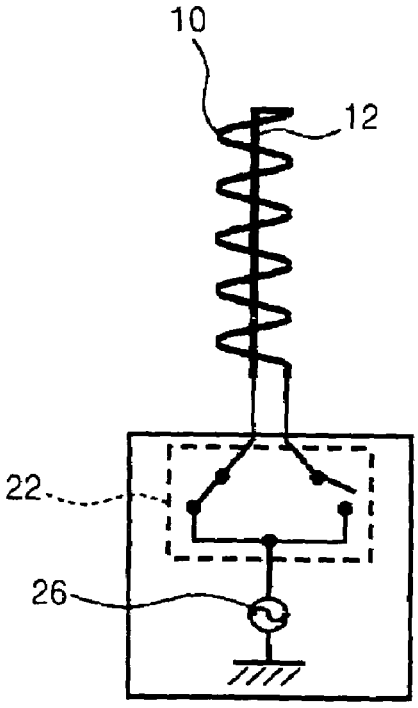
FIG. 8B illustrates the switching circuit when the helical element is turned off.
Figure 8C:
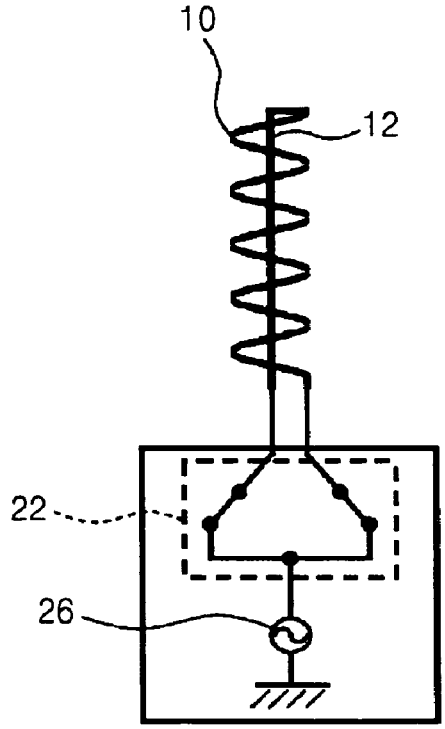

FIGS. 8A through 8C illustrate first, second and third connection states of the switching circuit 22 according to the present invention. As shown in the first state in FIG. 8A, when the switching circuit 22 switches off a linear element 12 but switches on a helical element 10, the switching circuit 22 is connected to the feeding unit 26. As shown in the second state in FIG. 8B, when the switching circuit 22 switches on the linear element 12 but switches off the helical element 10, the switching circuit 22 is connected to the feeding unit 26. As shown in third state in FIG. 8C, when the switching circuit 22 switches on both the helical element 10 and the linear element 12, the switching circuit 22 is connected to the feeding unit 26. Since the VSWR of the antenna unit 8 varies with a connection state of the switching circuit 22, the connection state of the switching circuit 22 may be selected depending on the environment in which it is used.

The results of a simulation performed on an antenna device according to the present invention will now be described.

Figure 9:
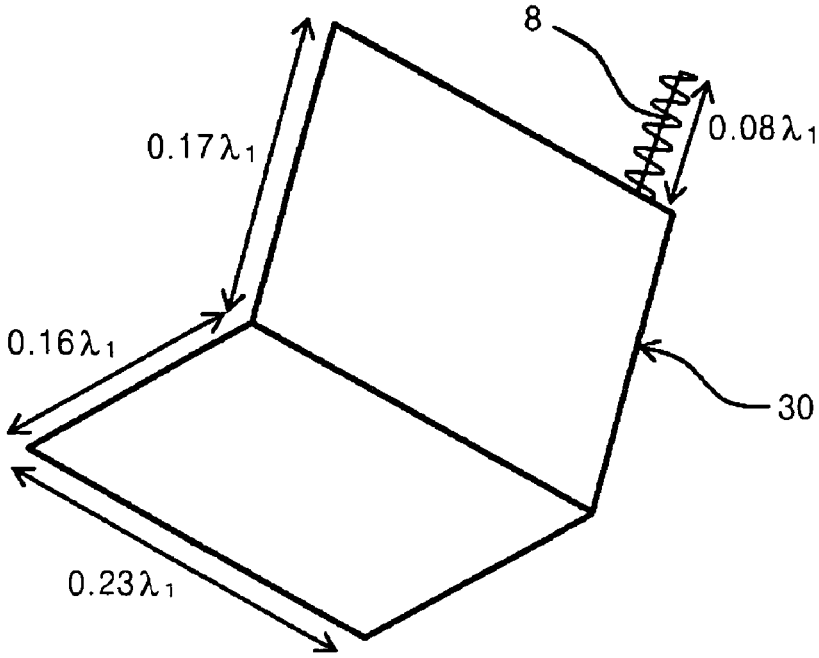
FIG. 9 illustrates an antenna device used in a first simulation.

FIG. 9 illustrates an antenna device used in a first simulation. An antenna unit 8 including a first element 10 having a helical shape and a second element 12 having a linear shape is installed on a board having a laptop computer shape. The first element 10 is connected to the feeding unit 26, and the second element 12 is connected to the matching adjusting circuit 24.

Figure 10:
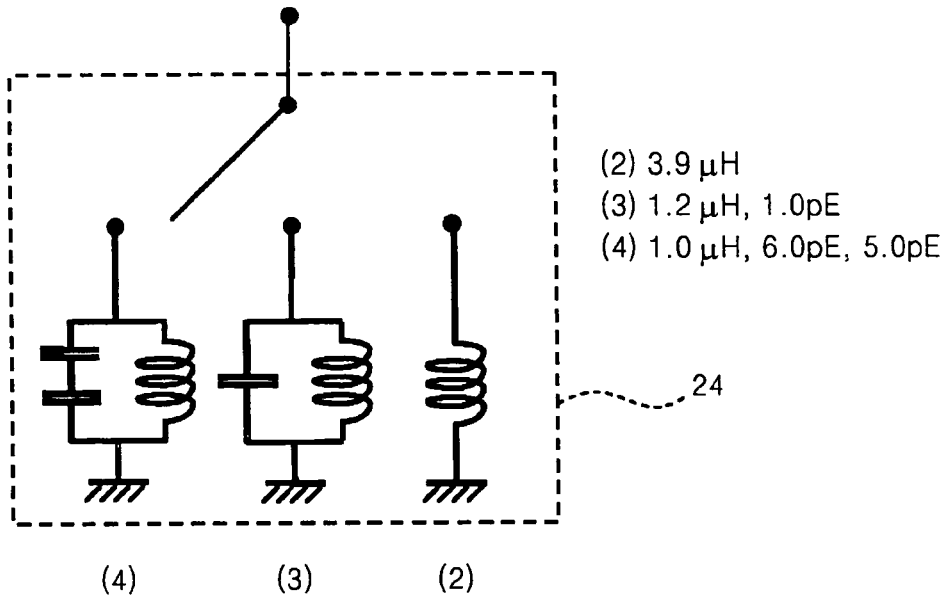
FIG. 10 illustrates a matching adjusting circuit according to the present invention.
Figure 11:
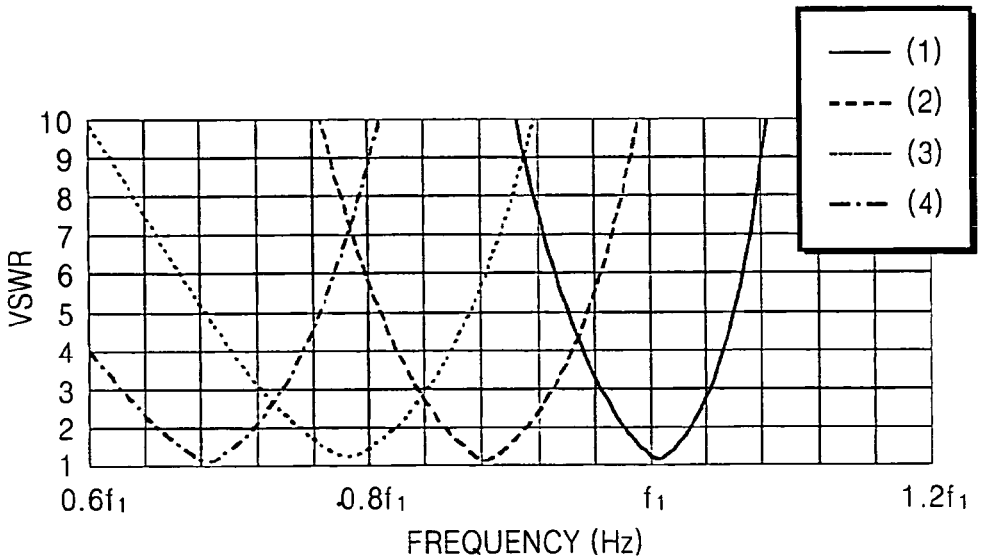
FIG. 11 illustrates a Voltage Standing Wave Ratio (VSWR) of an antenna unit according to the present invention.

FIG. 10 illustrates a sixth matching adjusting circuit 24 according to the present invention, and FIG. 11 illustrates the results of a simulation performed on a VSWR of the antenna unit 8 illustrated in FIGS. 9 and 10.

In the present embodiment, a switch is turned on, a resonant frequency is f1, a wavelength of the resonant frequency is λ1, and a helical element has a diameter of about 0.008λ1, a pitch of about 0.014λ1, and a number of turns of 5.73. The antenna unit 8 has a length of about 0.08λ1. The size corresponding to a liquid crystal display is about 0.17λ1×0.23λ1, and the size corresponding to a keyboard is about 0.16λ1×0.23λ1, of a board 30.

Referring to FIG. 10, (2) denotes an inductor of 3.9 microhenry (μH), (3) denotes a circuit including an inductor of 1.2 μH and a capacitor of 1.0 picofarad (pF), which are connected in parallel, and (4) denotes a circuit including capacitors of 6.0 pH and 5.0 pH which are connected in parallel with an inductor of 1.0 μH.

Referring to FIG. 11, a solid line (1) denotes the VSWR of the antenna unit 8 when the switch is turned on. Here, the resonant frequency is f1.

A bold broken line (2) denotes the VSWR of the antenna unit 8 when the antenna unit 8 is connected to the inductor (2) illustrated in FIG. 10. Here, the resonant frequency is about 0.88f1.

A slender broken line (3) denotes the VSWR of the antenna unit 8 when the antenna unit 8 is connected to the circuit (3) including the inductor and the capacitor illustrated in FIG. 10. Here, resonant frequency is about 0.68f1.

An alternating long and short dash line (4) denotes the VSWR of the antenna unit 8 when the matching adjusting circuit 24 is inserted into the circuit (4) illustrated in FIG. 10. Here, an intermediate frequency is 0.68f1.

As described above, a circuit of the matching adjusting circuit 24 may be selected in order to vary the resonant frequency of the antenna unit 8. Also, a helical element and a linear element may be connected to each other in order to reduce a length of the antenna unit 8 to about 0.08λ1.

Such a compact antenna device may be installed in a portable terminal such as a laptop or a Personal Data Assistant (PDA) in order to transmit and/or receive a radio signal in a desired frequency band. In particular, a TV signal in a band between a Very High Frequency (VHF) band to an Ultra High Frequency (UHF) band may be easily received.

Figure 12:
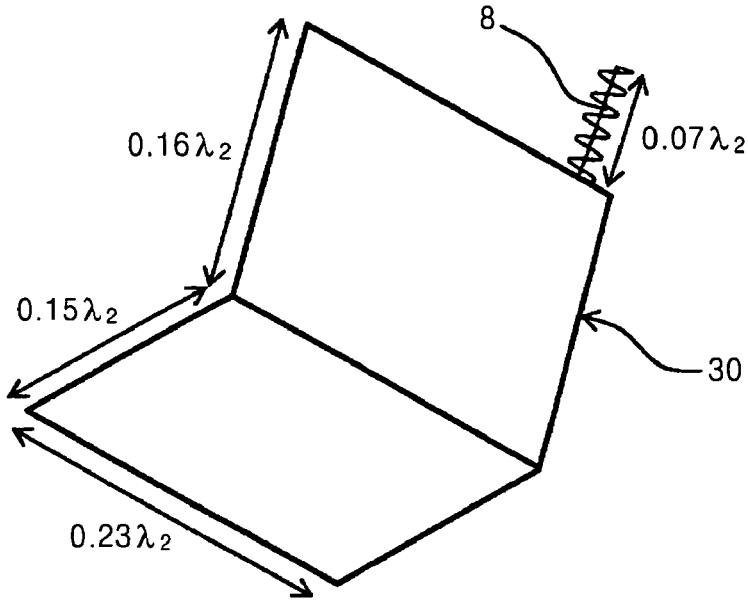
FIG. 12 illustrates an antenna device used in a second simulation.

FIG. 12 illustrates an antenna device used in a second simulation. An antenna unit 8 including a first element 10 having a helical shape and a second element 12 having a linear shape is installed on a board having a laptop computer shape. The antenna unit 8 is connected to the switching circuit 22 as shown in FIGS. 8A through 8C.

Figure 13:
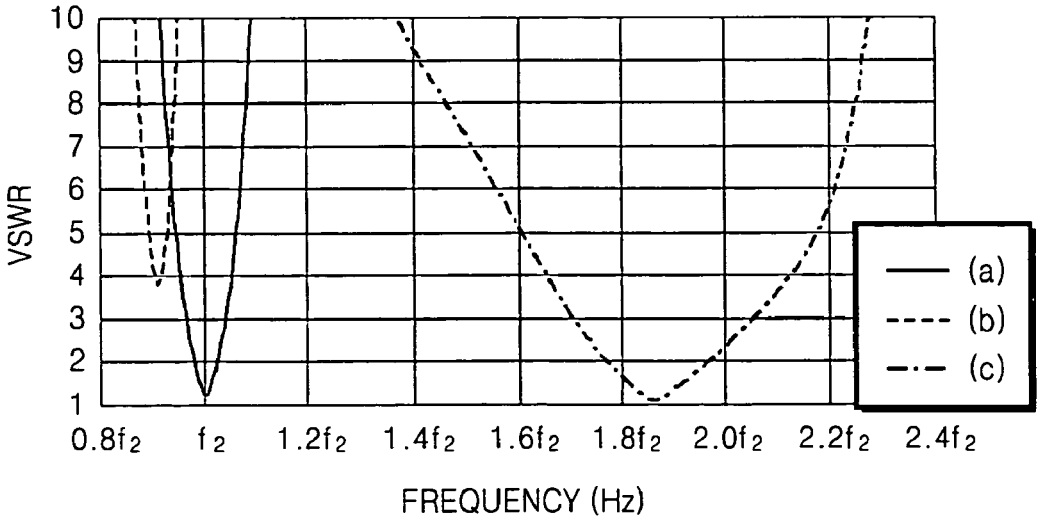
FIG. 13 illustrates the VSWR of the antenna unit according to the present invention.

FIG. 13 illustrates the results of a simulation of a VSWR of the antenna unit 8 illustrated in FIG. 12. Referring to FIG. 13, a solid line (a) denotes the VSWR of the antenna unit 8 connected to the feeding unit 26 when the first element 10 having the helical shape is switched on as illustrated in FIG. 8A. Here, a resonant frequency is f2.

A broken line (b) denotes the VSWR of the antenna unit 8 connected to the feeding unit 26 when the first element 10 having the helical shape is switched off as illustrated in FIG. 8B. Here, the resonant frequency is about 0.912f2.

An alternated long and short dash line (c) denotes the VSWR of the antenna unit 8 when the first and second elements 10 and 12 are switched on to be connected to the feeding unit 26 as illustrated in FIG. 8C. Here, the resonant frequency is about 1.86f2.

As described above, the resonant frequency can be adjusted. If a wavelength of the resonant frequency f2 is λ2, the first element 10 having the helical shape may have a diameter of about 0.008λ2, a pitch of about 0.005λ2, and a number of turns of 12.92 as illustrated in FIG. 12. Also, the antenna unit 8 may have a length of about 0.07λ2. The size corresponding to a liquid crystal display is about 0.16λ2×0.23λ2, and the size corresponding to a keyboard is about 0.15λ2×0.23λ2, of a board 30.

It has been described that the first element 10 has a helical shape, and the second element 12 has a linear shape. However, the present invention is not limited to these shapes. Hereinafter, modifications of shapes of the first and second elements 10 and 12 will be described. In the following, at least one element includes a part having a different shape from a linear shape. Thus, if an element is helical, another element may be linear, helical, meandering, or zigzag shaped.

Figure 14A:
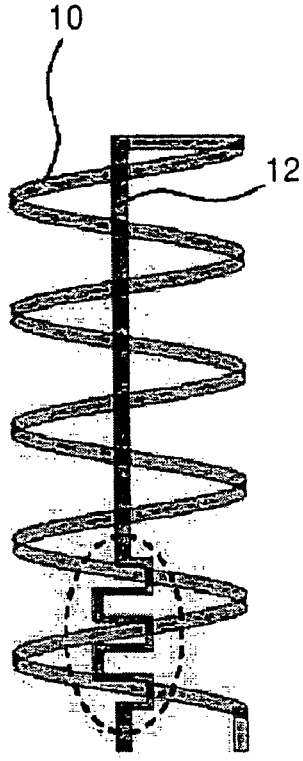
FIGS. 14A and 14B illustrate modifications to an antenna having a helical element.

If an element is meandering, another element may be linear, zigzag, or zigzag-linear. A part of the other element may have another shape. Referring to FIGS. 14A through to 17B, a first element is helical, and a second element includes a part having a different shape from the other part of the second element. As shown in FIGS. 14A, 15A, 16A, and 17A, the first element 10 may be disposed around a central axis of the second element 12. As shown in FIGS. 14B, 15B, 16B, and 17B, the second element 12 may be disposed outside the first element 10.

Figure 14B:
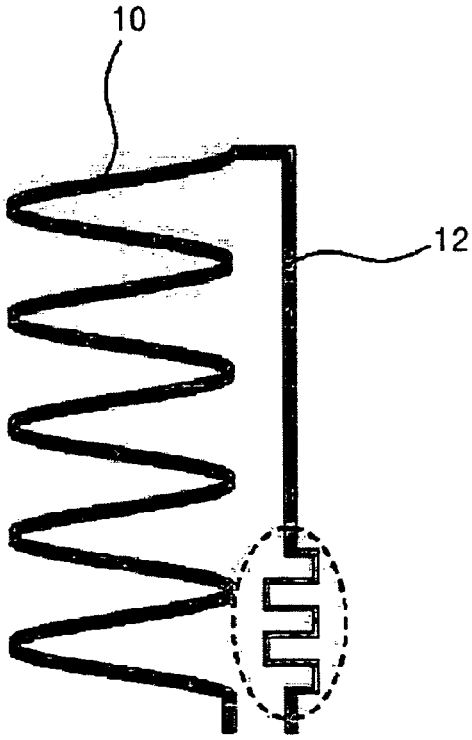
Figure 15A:
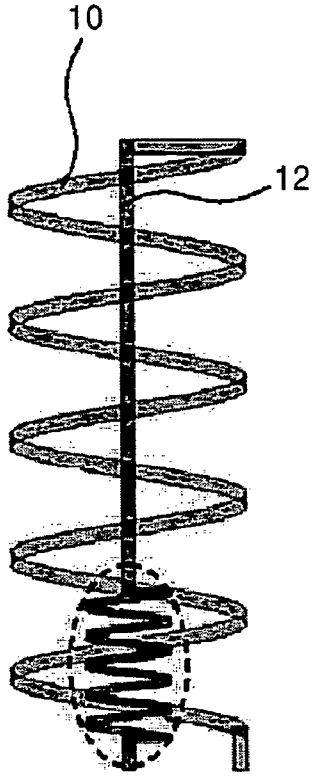
FIGS. 15A and 15B illustrate modifications to an antenna having a helical element.
Figure 15B:
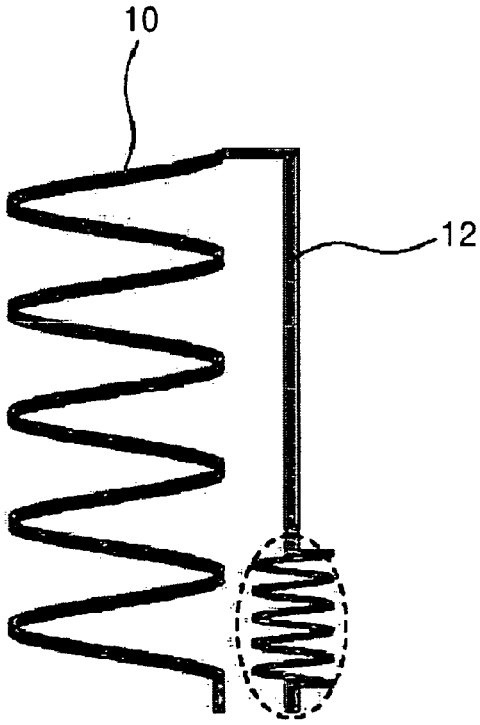
Figure 16A:
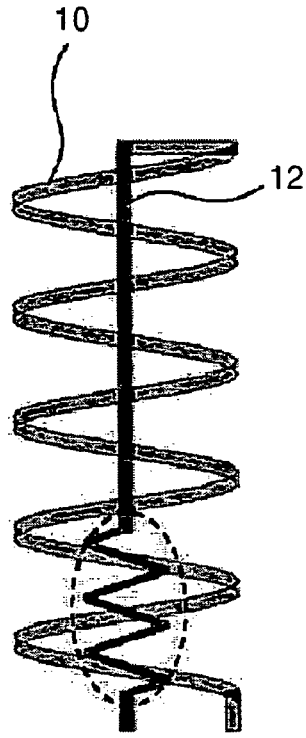
FIGS. 16A and 16B illustrate modifications to an antenna having a helical element.
Figure 16B:
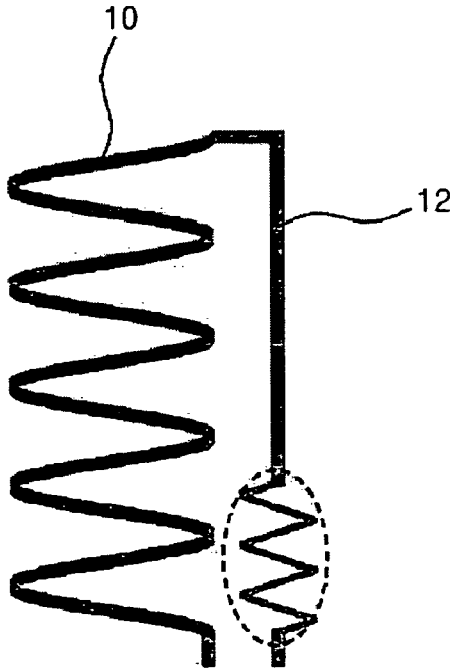
Figure 17A:
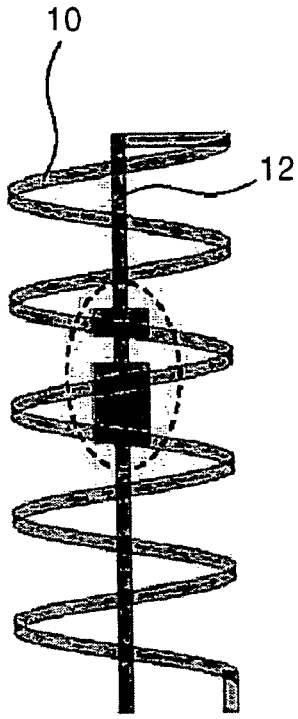
FIGS. 17A and 17B illustrate modifications to an antenna having a helical element.
Figure 17B:
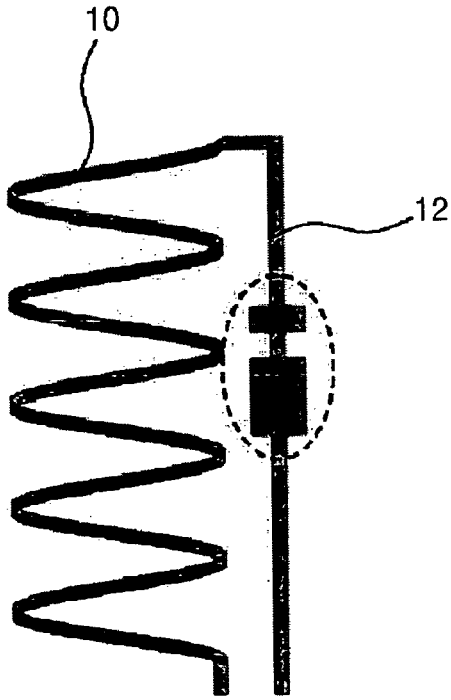

Referring to FIGS. 14A and 14B, a part of the second element 12 may be meandering as indicated with a broken line. Referring to FIGS. 15A and 15B, the part of the second element 12 may be helical as indicated with a broken line. Referring to FIGS. 16A and 16B, part of the second element 12 may be zigzag shaped as indicated with a broken line. Referring to FIGS. 17A and 17B, a width or thickness of a conductor of part of the second element 12 may vary as indicated with a broken line.

Referring to FIGS. 18A through 22B, an element, for example, the first element 10, is meandering, and another element, for example, the second element 12, includes a part having a different shape from the other part of the second element 12. A meandering shape is nearly planar. Referring to FIGS. 18A, 19A, 20A, 21A, and 22A, the second element 12 may overlap with the first element 10. Referring to FIGS. 18B, 19B, 20B, 21B, and 22B, the second element 12 may be disposed parallel with the first element 10 on the same plane.

Figure 18A:
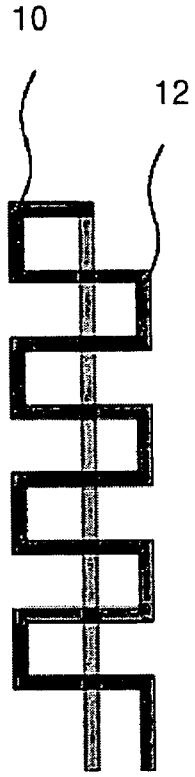
FIGS. 18A and 18B illustrate modifications to an antenna having a meander element.
Figure 18B:
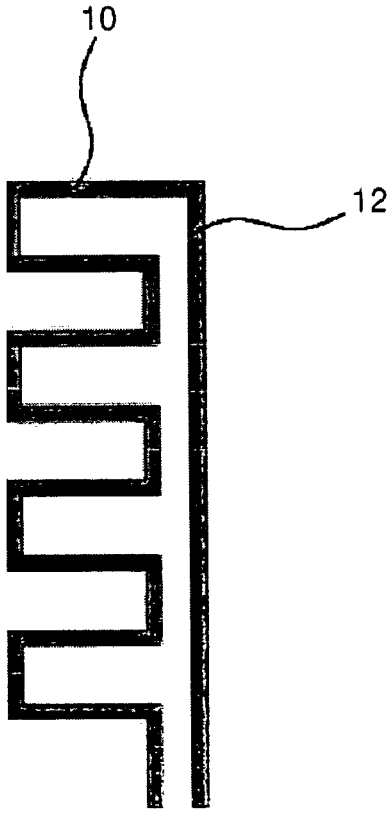
Figure 19A:
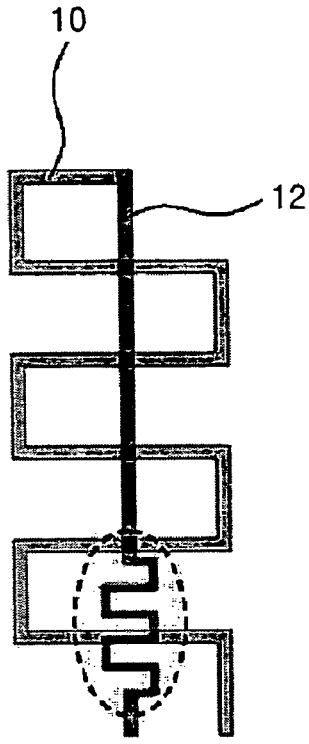
FIGS. 19A and 19B illustrate modifications to an antenna having a meander element.
Figure 19B:
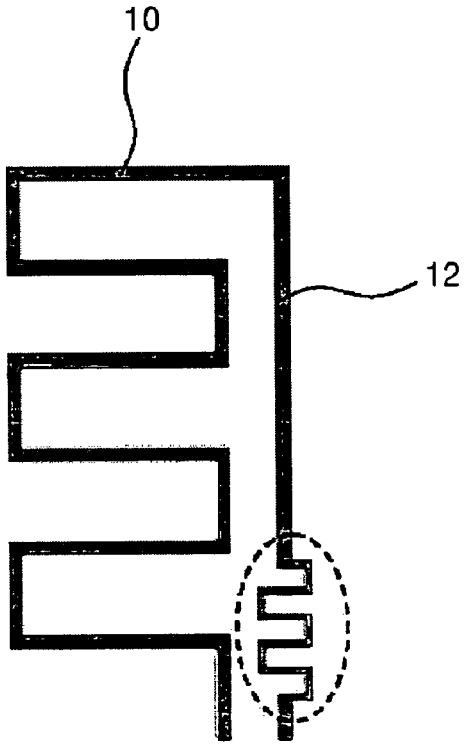
Figure 20A:
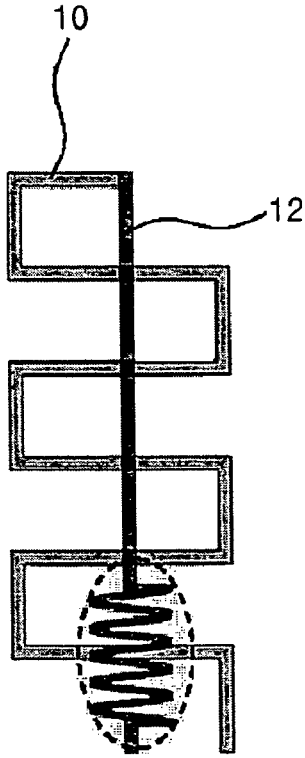
FIGS. 20A and 20B illustrate modifications to an antenna having a meander element.
Figure 20B:
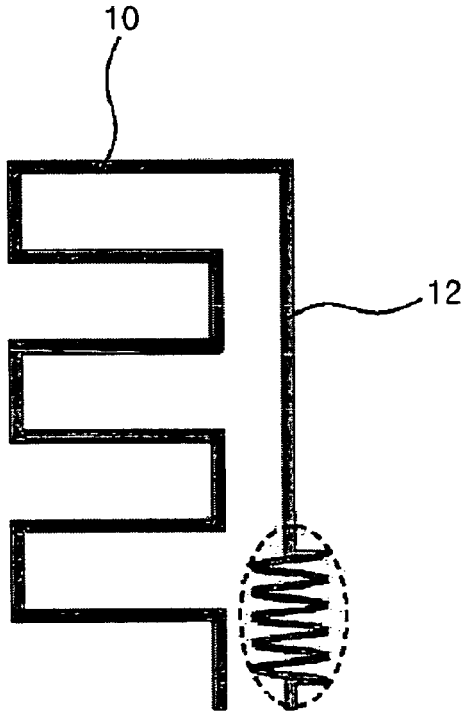
Figure 21A:
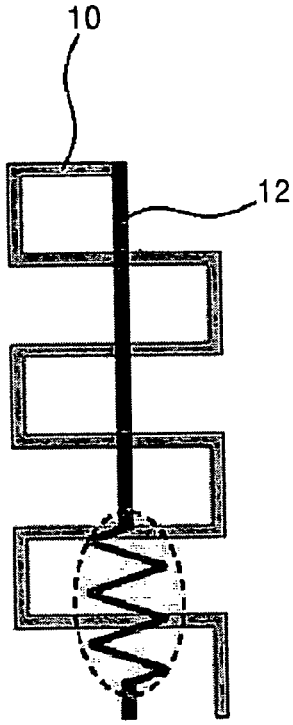
FIGS. 21A and 21B illustrate modifications to an antenna having a meander element.
Figure 21B:
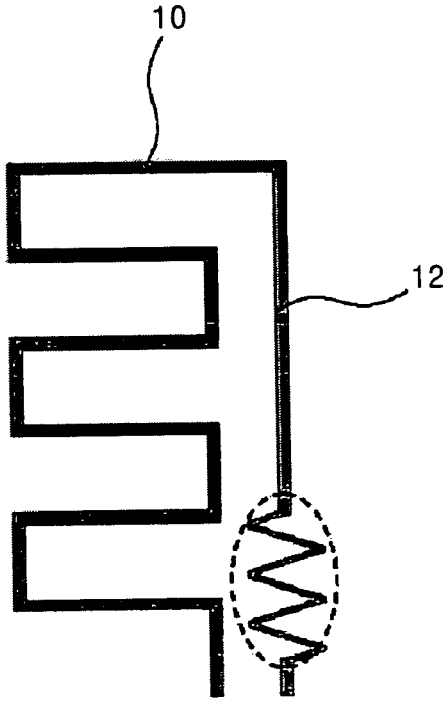
Figure 22A:
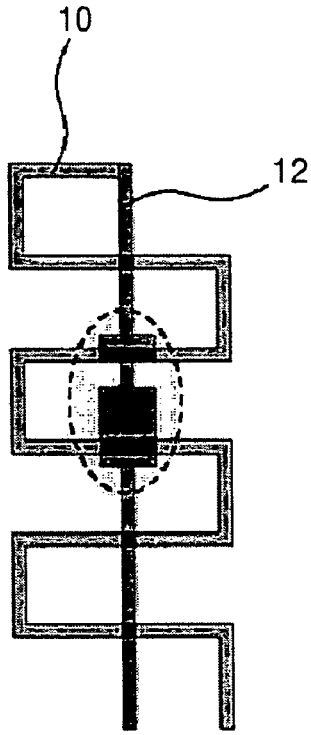
FIGS. 22A and 22B illustrate modifications to an antenna having a meander element.
Figure 22B:
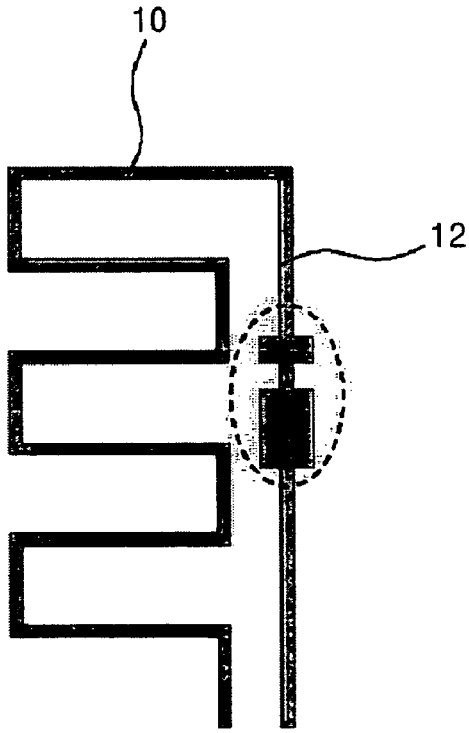

Referring to FIGS. 18A and 18B, the first element 10 has a meandering shape, and the second element 12 has a linear shape. Referring to FIGS. 19A and 19B, a part of the second element 12 is meandering as indicated with a broken line. Referring to FIGS. 20A and 20B, a part of the second element 12 is helical as indicated with a broken line. Referring to FIGS. 21A and 21B, the part of the second element 12 is zigzag shaped as indicated with a broken line. Referring to FIGS. 22A and 22B, a width or thickness of a conductor of a part of the second element 12 various as indicated with a broken line. Also, modifications of intervals and widths (diameters) of meandering, zigzag shaped, and helical shapes are within the scope of the present invention.

The first element 10 may not include a part having a different shape as shown in FIGS. 14A through 22B or may include a part having a different shape. Also, in any of the above-described structures, two elements may be connected at the top part 13 and thus lengthened so as to reduce a resonant frequency and make the antenna device more compact. Also, two elements having different electric lengths may be installed, and any of the three ways of connecting terminals of the two elements to a feeding unit through a switching circuit may be selected. As a result, a resonant frequency may be selected in three different cases: In addition, a frequency may be tuned by a matching adjusting circuit including an inductor and a capacitor.

As described above, a compact antenna device according to the present invention is installed in a portable terminal and is tunable to a resonant frequency. The resonant frequency is adjusted using a switching circuit, and the frequency is tuned using the matching adjusting circuit. Thus, the compact antenna device widens a frequency band.

While the present invention has been particularly shown and described with reference to preferred embodiments thereof, it will be understood by those of ordinary skill in the art that various changes in form and details may be made therein without departing from the spirit and scope of the present invention as defined by the following claims.

What is claimed is:

1. An antenna device comprising:

an antenna unit having first and second elements, the first element including a first antenna terminal having at least one of meandering and curved patterns wholly or partially, and the second element including a first end connected to an end of the first element and a second end having a second antenna terminal;

a feeding unit exciting the antenna unit through the first and second antenna terminals;

a switching circuit connected between the antenna unit and the feeding unit and selectively switching one or both of the first and second elements in order to connect one or both of the first and second elements to the feeding unit, wherein a resonant frequency of the antenna unit varies during feeding by the feeding unit depending on a switching operation of the switching circuit.

2. The antenna device of claim 1, further comprising a matching adjusting circuit connected to the switching circuit and adjusting the resonant frequency of the antenna units, wherein the switching circuit connects one of the first and second elements to the feeding unit and another one of the first and second elements, which is not connected to the feeding unit, to the matching adjusting circuit.

3. The antenna device of claim 1, wherein the second element has a shorter length than the first element.

4. The antenna device of claim 1, wherein the second element overlaps the first element.

5. The antenna device of claim 1, wherein the second element is separated from the first element.

6. The antenna device of claim 1, wherein the first element has one of helical, meandering and zigzag shapes.

7. The antenna device of claim 1, wherein the second element includes a part having a different shape from another part of the second element.

8. The antenna device of claim 7, wherein the second element has at least one of meandering, linear and zigzag shapes.

9. An antenna device comprising:

an antenna unit having first and second elements, the first element includes a first antenna terminal having at least one of meandering and curved patterns wholly or partially, and the second element including a first end connected to an end of the first element and a second end having a second antenna terminal;

a matching adjusting circuit connected to one of the first and second antenna terminals and adjusting a resonant frequency of the antenna unit; and a feeding unit exciting the antenna unit through another one of the first and second antenna terminals which is not connected to the matching adjusting circuit.

10. The antenna device of claim 9, wherein the second element has a shorter length than the first element.

11. The antenna device of claim 9, wherein the second element overlaps the first element.

12. The antenna device of claim 9, wherein the second element is separated from the first element.

13. The antenna device of claim 9, wherein the first element has one of helical, meandering and zigzag shapes.

14. The antenna device of claim 9, wherein the second element includes a part having a different shape from another part of the second element.

15. The antenna device of claim 14, wherein the second element has at least one of meandering, linear and zigzag shapes.

* * * * *